US010692639B2

(12) United States Patent
Jerez et al.

(10) Patent No.: US 10,692,639 B2
(45) Date of Patent: Jun. 23, 2020

(54) INDUCTIVE COMPONENT AND METHOD FOR PRODUCING AN INDUCTIVE COMPONENT

(71) Applicant: EPCOS AG, Munich (DE)

(72) Inventors: Felipe Jerez, Elchingen (DE); Stephan Bühlmaier, Langenau (DE); Anneliese Drespling, Heidenheim (DE); Jörn Schliewe, Steinheim (DE); Stefan Schefler, Ulm (DE); Joachim Nassal, Heidenheim (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 15/125,077

(22) PCT Filed: Feb. 6, 2015

(86) PCT No.: PCT/EP2015/052524
§ 371 (c)(1),
(2) Date: Sep. 9, 2016

(87) PCT Pub. No.: WO2015/135703
PCT Pub. Date: Sep. 17, 2015

(65) Prior Publication Data

US 2017/0025212 A1 Jan. 26, 2017

(30) Foreign Application Priority Data

Mar. 12, 2014 (DE) ..... 10 2014 103 324

(51) Int. Cl.
*H01F 17/04* (2006.01)
*H01F 19/04* (2006.01)
(Continued)

(52) U.S. Cl.
CPC ..... *H01F 19/04* (2013.01); *H01F 17/045* (2013.01); *H01F 27/2823* (2013.01);
(Continued)

(58) Field of Classification Search
USPC ..... 336/192
See application file for complete search history.

(56) References Cited

U.S. PATENT DOCUMENTS 6,348,850 B1 2/2002 Kimura et al.
6,373,366 B1 4/2002 Sato et al.
(Continued)

FOREIGN PATENT DOCUMENTS

DE 102007036052 A1 2/2009
DE 102011116410 A1 4/2012
(Continued)

OTHER PUBLICATIONS

English translation of JP2004146662 (Year: 2004).*

*Primary Examiner* — Ronald Hinson
(74) *Attorney, Agent, or Firm* — Slater Matsil, LLP

(57) ABSTRACT

An inductive component and a method for producing an inductive component are disclosed. In an embodiment, the inductive component includes a first core part having wound first and second wires and a second core part arranged on the first core part. In various embodiments the inductive component has a low mode conversion, a low inductance in differential-mode operation, a high inductance for common-mode signals, a constant characteristic impedance, a low capacitive coupling of the wires, and/or a low leakage inductance.

7 Claims, 10 Drawing Sheets

(51) Int. Cl.

| | |
|---|---|
| ***H01F 41/069*** | (2016.01) |
| ***H01F 41/07*** | (2016.01) |
| ***H01F 27/29*** | (2006.01) |
| ***H01F 41/076*** | (2016.01) |
| ***H01F 27/28*** | (2006.01) |
| ***H01F 41/02*** | (2006.01) |
| *H01F 17/00* | (2006.01) |
| *H01F 27/26* | (2006.01) |
| *H01F 3/14* | (2006.01) |

(52) U.S. Cl.

CPC ..... *H01F 27/29* (2013.01); *H01F 27/292* (2013.01); *H01F 41/0206* (2013.01); *H01F 41/069* (2016.01); *H01F 41/07* (2016.01); *H01F 41/076* (2016.01); *H01F 3/14* (2013.01); *H01F 27/263* (2013.01); *H01F 2017/0093* (2013.01)

(56) References Cited

U.S. PATENT DOCUMENTS

| | | | | |
|---|---|---|---|---|
| 6,472,969 | B1 | 10/2002 | Hanato | |
| 6,938,327 | B2 | 9/2005 | Takayama et al. | |
| 6,965,289 | B2 * | 11/2005 | Toi | H01F 17/045 336/200 |
| 7,078,988 | B2 * | 7/2006 | Suzuki | H03H 7/427 333/181 |
| 7,196,608 | B2 * | 3/2007 | Hirai | H01F 17/045 336/200 |
| 7,471,179 | B2 | 12/2008 | Hatakeyama et al. | |
| 7,855,627 | B2 * | 12/2010 | Nishikawa | H01F 17/045 336/200 |
| 2004/0263285 | A1 | 12/2004 | Suzuki et al. | |
| 2008/0224813 | A1 | 9/2008 | Hirai et al. | |
| 2009/0045902 | A1 | 2/2009 | Hirai | |
| 2010/0194517 | A1 | 8/2010 | Karasek et al. | |

FOREIGN PATENT DOCUMENTS

| | | | |
|---|---|---|---|
| EP | 1699060 | A2 | 9/2006 |
| JP | 548320 | U | 6/1993 |
| JP | 1197274 | A | 4/1999 |
| JP | 2000208331 | A | 7/2000 |
| JP | 2000286137 | A | 10/2000 |
| JP | 2004146662 | A | 5/2004 |
| JP | 2005093564 | A | 4/2005 |
| JP | 2006121013 | A | 5/2006 |
| JP | 2006339250 | A | 12/2006 |
| JP | 2007067206 | A | 3/2007 |
| JP | 2007165407 | A | 6/2007 |
| JP | 2008034777 | A | 2/2008 |
| JP | 2008186996 | A | 8/2008 |
| JP | 2010141191 | A | 6/2010 |
| JP | 2011253888 | A | 12/2011 |
| WO | 2007060961 | A1 | 5/2007 |

* cited by examiner

INDUCTIVE COMPONENT AND METHOD FOR PRODUCING AN INDUCTIVE COMPONENT

This patent application is a national phase filing under section 371 of PCT/EP2015/052524, filed Feb. 6, 2015, which claims the priority of German patent application 10 2014 103 324.8, filed Mar. 12, 2014, each of which is incorporated herein by reference in its entirety.

TECHNICAL FIELD

The invention relates to an inductive component that can be used for example as a data line inductor in radio-frequency applications, in particular in applications with high-speed data buses, for example Ethernet buses. Furthermore, the invention relates to a method for producing such an inductive component.

BACKGROUND

A data line inductor, for which the English designation "common mode choke" is also used as an alternative, comprises a core, for example a ferrite core, on which a first wire and a second wire are wound. The data line inductor serves for transmitting differential signals, wherein the signals flow for example on the first wire as outgoing conductor from the transmitter to the receiver and on the second wire as return conductor from the receiver to the transmitter.

While the data line inductor for the transmission of differential signals is intended to act as conductor via which differential signals are intended to be transmitted with a high data rate and low damping, the transmission of common-mode signals that flow in the same direction in the first and second wires of the data line inductor is intended to be suppressed or damped by the component. For common-mode signals the data line inductor is intended to constitute a high inductance.

Furthermore, the inductive component is intended to generate no or at most a small mode conversion. This is intended to prevent a situation in which a differential-mode data signal is transmitted to the data line inductor and an interference signal is generated therefrom in the inductor. In order to transmit differential-mode signals with low or virtually no damping at all via the inductive component, the component is intended to have a low inductance (leakage inductance) in differential-mode operation for data signals and a high inductance for the transmission of common-mode signals/interference signals. In order to transmit differential-mode signals without damping or with low damping, it is demanded that the leakage inductance of the inductive component is low and the ohmic losses that occur when transmitting data signals via the inductive component are low.

SUMMARY OF THE INVENTION

Embodiment provide an inductive component which enables the data transmission of differential signals virtually without damping, but damps interference signals to the greatest possible extent and has a compact design. Furthermore, embodiment provide a method for producing such an inductive component.

In accordance with one embodiment, the inductive component comprises a first and a second wire, a core having a first core part and a second core part, wherein the first core part has a first and second flange section and a wire winding section for winding with the first and second wires, and a multiplicity of contact mounts for contacting a respective end of the first and second wires. The first and second flange sections are arranged at different ends of the wire winding section. The first and second flange sections have a respective first surface, a respective second surface and a respective third surface. The respective first and second surfaces of the first and second flange sections are arranged opposite relative to the respective third surface of the first and second flange sections. The second core part is arranged on the respective third surface of the first and second flange sections. The first and second flange sections have a respective groove that separates the respective first and second surfaces of the first and second flange sections from one another. A first end of the first wire is held at a first of the contact mounts. A second end of the first wire is held at a second of the contact mounts. A first end of the second wire is held at a third of the contact mounts and a second end of the second wire is held at a fourth of the contact mounts. The first and third contact mounts are arranged at the first flange section, while the second and fourth contact mounts are arranged at the second flange section. The first wire proceeding from the first contact mount is led through the groove of the first flange section, wound around the wire winding section and led through the groove of the second flange section to the second contact mount. The second wire proceeding from the third contact mount is led through the groove of the first flange section, wound around the wire winding section and led through the groove of the second flange section to the fourth contact mount.

A method for producing the inductive component is specified in the disclosure. In accordance with the method for producing an inductive component as specified in this disclosure, a first and a second wire are provided. Furthermore, a core having a first core part and a second core part is provided, wherein the first core part has a first and second flange section and a wire winding section for winding with the first and second wires. The first and second flange sections are arranged at different ends of the wire winding section, wherein the first and second flange sections have a respective first surface, a respective second surface and a respective third surface. The respective first and second surfaces of the first and second flange sections are arranged opposite relative to the respective third surface of the first and second flange sections. The second core part is arranged on the respective third surface of the first and second flange sections. The first and second flange sections have a respective groove that separates the respective first and second surfaces of the first and second flange sections from one another. Furthermore, the method involves providing a multiplicity of contact mounts comprising a first and second contact mount for contacting a respective end of the first wire and comprising a third and fourth contact mount for contacting a respective end of the second wire. The first and third contact mounts are arranged at the first flange section. The second and fourth contact mounts are arranged at the second flange section. A first end of the first wire is fixed to the first contact mount, and a first end of the second wire is fixed to the third contact mount. The first wire is led through the groove of the first flange section, the wire winding section is wound with the first wire, and the first wire is led through the groove of the second flange section. The second wire is led through the groove of the first flange section, the wire winding section is wound with the second wire, and the second wire is led through the groove of the second flange section. A second end of the first wire is fixed to the second contact mount, and a second end of the second wire is fixed to the fourth contact mount.

The specified production method can be used to provide an inductive component which has a high inductance for the transmission of common-mode signals, for example an inductance of greater than 200 μH, a low inductance for the transmission of signals in differential-mode operation, for example an inductance of less than 0.1% of the common-mode inductance. As a result of the high inductance for common-mode signals, the transmission of interference signals takes place with a high damping. In addition, the first and second wires have a low DC resistance, which for example is less than 6 ohms, as a result of which the damping of data signals is low. The inductive component is furthermore distinguished by a low mode conversion, as a result of which the emission of interference radiation is reduced.

Furthermore, the inductive component has a low leakage inductance and thus guarantees a low insertion loss. For differential data signals, the component has a constant characteristic impedance. The inductance component is suitable in particular for use in radio-frequency applications and in particular in communication networks for transmitting radio-frequency data signals and in high-speed data buses, for example in Ethernet buses.

The first and second wires can be wound in twisted form on the wire winding section of the first core part. The coupling between the adjacent turns and the material of the core can be reduced as a result. A reduction of the magnetic leakage flux can thus be avoided on account of the twisted wire winding. The wires can have a high insulation strength, for example with a degree of insulation starting from 3. The high insulation strength makes it possible to set a characteristic impedance of a wire pair comprising the first and second wires. By selecting a suitable material and a suitable respective diameter of the first and second wires, it is possible to exactly set the characteristic impedance, the thermal behavior and the electrical insulation of the inductive component. By winding the wire winding section with a controlled pitch, it is possible to reduce the coupling capacitance over the winding.

The first and second wires can be wound on the wire winding section in such a way that the position of the first and second wires relative to one another is altered upon each individual complete turn of the first and second wires around the wire winding section. A turn should be understood to mean an individual 360° revolution of a wire around the wire winding section, while a wire winding should be understood to mean all turns of a wire on the wire winding section. On account of the twisting or the transposed arrangement of the first and second wires in adjacent turns, a low leakage inductance can also be achieved besides the reduction of the coupling capacitance between adjacent turns. The two wires can already be twisted before the actual winding of the wire winding section or can be twisted with one another during the winding of the wire winding section.

The first and second core parts can be shaped from a ferrite material. The core has a high permeability, for example of more than 1000. As a result, the core has a low reluctance. Furthermore, with a relatively small number of turns it is possible to achieve high inductance values, for example of more than 200 μH for Ethernet interfaces with low DC voltage resistances, for example of 6 ohms.

The first core part can be embodied with the wire winding section and the first and second flange sections as an I-core. The second core part can be shaped as a plate core that is connected to the two flange sections of the I-shaped first core part. The magnetic circuit can be closed via the flange sections and the plate core. A contact area between the respective flange sections of the first core part and the corresponding contact area of the plate core can be ground, such that a smooth, planar contact area can be formed between the first core part and the second core part. As a result, the inductance component has a high inductance for common-mode signals and at the same time a low DC resistance.

By virtue of the use of specific adhesive materials, the gap width between the plate core and the flange sections of the first core part can turn out to be very small. The ground surface of the two flange sections and the ground surface of the plate core enable the gap between the flange sections and the plate core to be as small as possible. The adhesive layer can be applied directly to a respective surface of the flange sections and/or the respectively opposite surfaces of the plate core. In order to reduce the gap width, an adhesive layer can also be arranged laterally above the gap between the plate core and the two flange sections. On account of the small gap width, the inductive component has a high effective permeability.

The groove provided in each of the flange sections enables a parallel guidance of the first and second wires from the corresponding contact mounts on the first flange section to the wire winding section and from there to the corresponding contact mounts on the second flange section. As a result, the two wires can be wound onto the wire winding section in a manner arranged between the first and second and respectively the third and fourth contact mounts with the same wire length and parallel to one another. The entire wire winding can be embodied symmetrically as a result.

Two contact mounts can be provided at each of the flange sections. Each of the contact mounts serves for fixing a respective end of the first and second wires. The contact mounts can each have a guide element for guiding the wire to a respective contacting element of the contact mounts. The contacting element is designed in particular for fixing the wire ends by laser welding.

BRIEF DESCRIPTION OF THE DRAWINGS

The invention is explained in greater detail below with reference to figures showing exemplary embodiments of the present invention. In the figures.

DETAILED DESCRIPTION OF ILLUSTRATIVE EMBODIMENTS

Figure 1A:
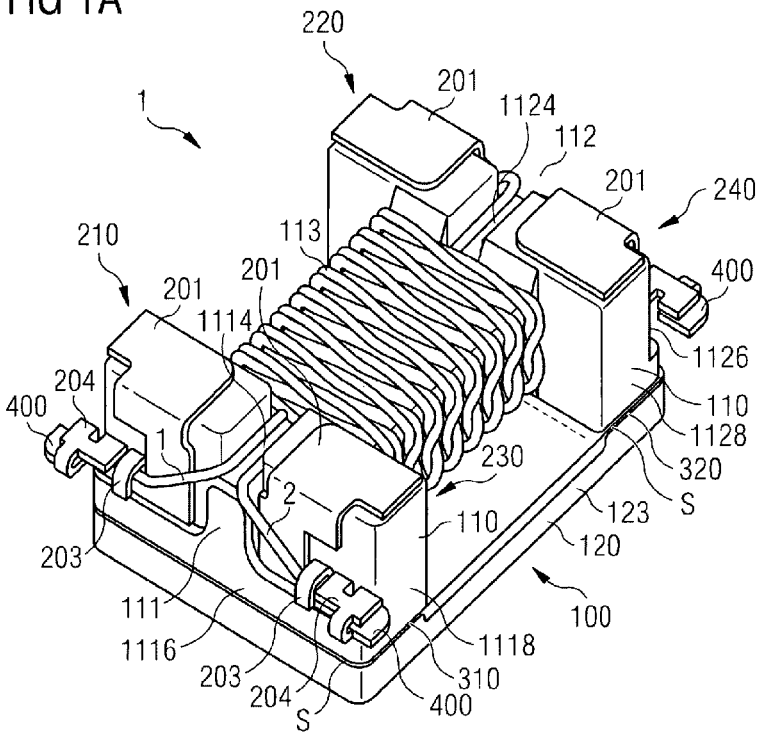
FIG. 1A shows a view of a first embodiment of an inductive component.
Figure 1B:
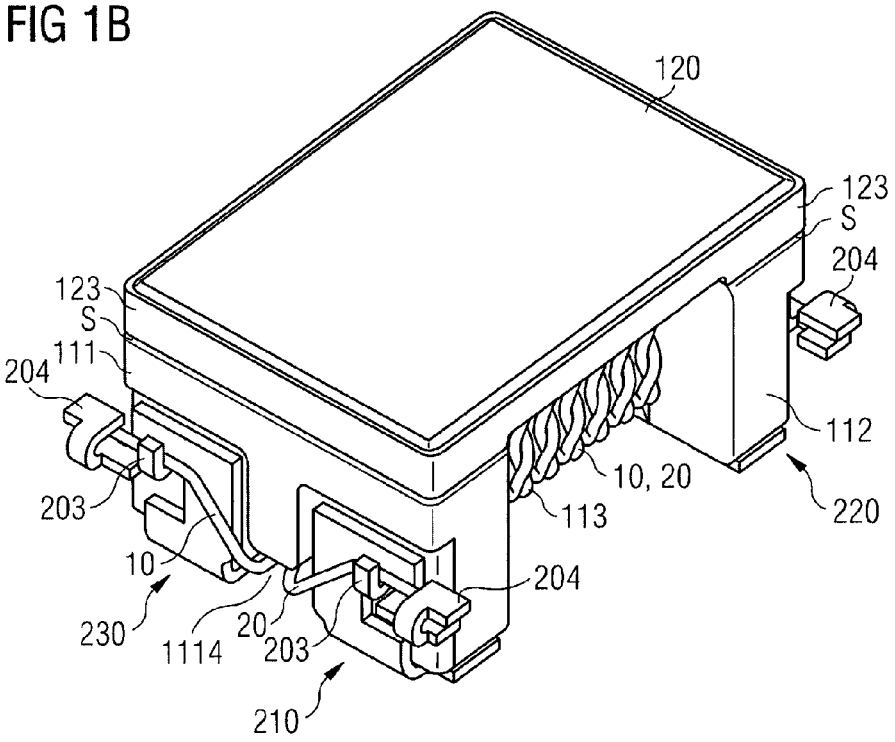
FIG. 1B shows a further view of the first embodiment of the inductive component.
Figure 7:
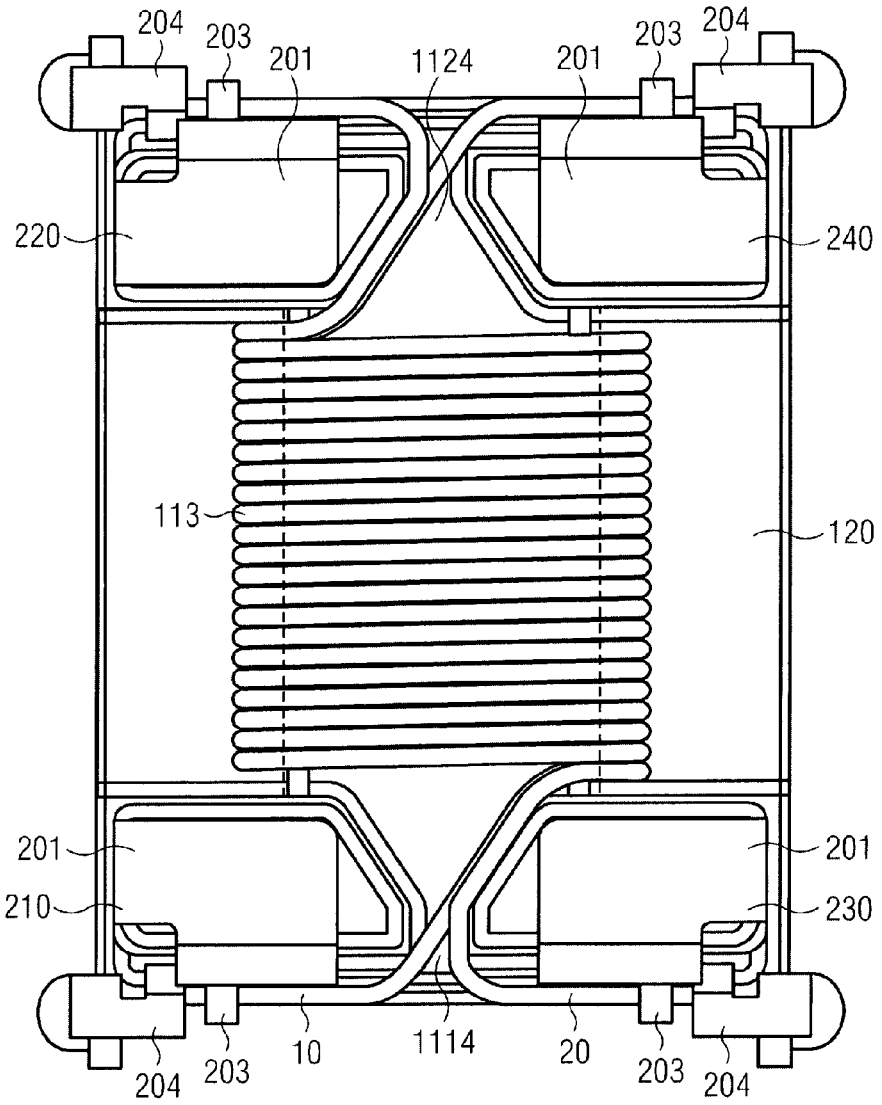
FIG. 7 shows a further view of the second embodiment of the inductive component.
Figure 8:
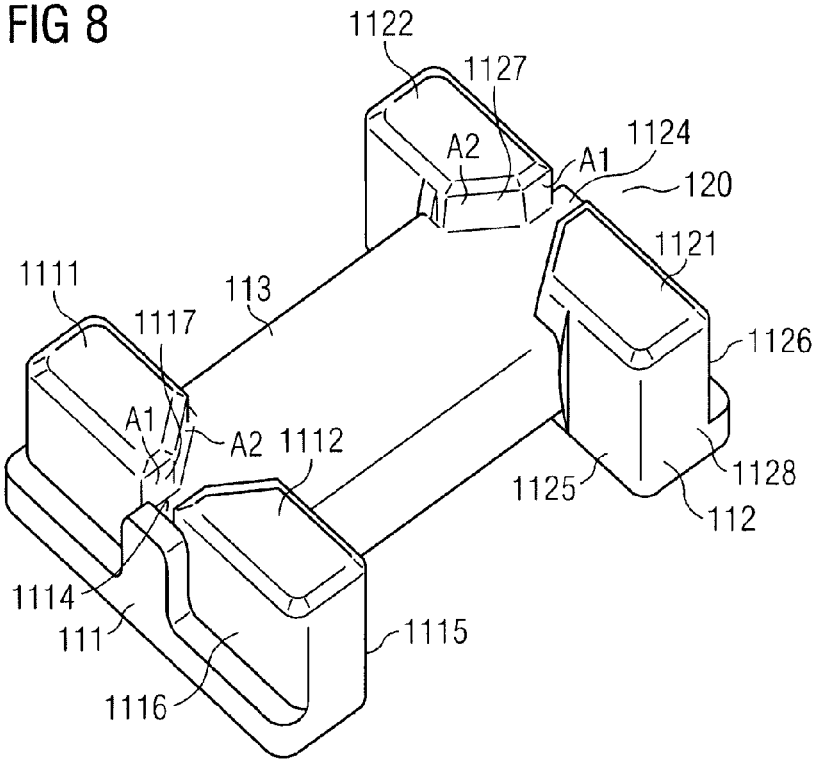
FIG. 8 shows one embodiment of a first core part of an inductive component.

FIGS. 1A and 1B show different views of a first embodiment 1 of an inductive component. FIGS. 7 and 8 show different views of a second embodiment of an inductive component. The inductive component shown in FIGS. 1A, 1B, and 7 and 8 can be embodied as a data line inductor (common-mode choke). The data line inductor can be used in radio-frequency applications, in particular in interfaces of high-speed communication networks, for example Ethernet buses. The component is distinguished by a low mode conversion, a low inductance in differential-mode operation, a high inductance for common-mode signals, a constant characteristic impedance and a symmetrical winding arrangement. Furthermore, the inductive component has a low capacitive coupling of the wires 10 and 20 and a low leakage inductance. In the case of an inductance value of, in particular, between 200 μH and 400 μH, the inductive component can have for example a length of between 2 mm and 5 mm, a width of between 2 mm and 5 mm and a height of between 2 mm and 5 mm.

FIG. 1A shows a first embodiment 1 of the inductive component from the underside, while FIG. 1B shows the inductive component 1 from the opposite top side. The component comprises a wire 10 and a wire 20 serving as outgoing and return conductors, respectively, of a differential signal. Furthermore, the inductive component comprises a core 100 having a core part 110 and a core part 120. The core part 110 can be embodied as a so-called I-core. The core part 110 can comprise a flange section 111, a flange section 112 and a wire winding section 113 for winding with the wires 10 and 20. The flange sections 111 and 112 are arranged at different ends of the wire winding section 113. The core part 120 can be embodied as a plate core that is fitted on the flange sections 111 and 112 of the core part 110 for closing the magnetic circuit. The core part 120 can be held at the core part 110 for example by an adhesive connection.

The inductive component comprises a multiplicity of contact mounts 210, 220, 230 and 240 for contacting a respective end of the wires 10 and 20. A first end of the wire 10 is held at a contact mount 210 and a second end of the wire 10 is held at a contact mount 220. A first end of the wire 20 is held at the contact mount 230 and a second end of the wire 20 is held at the contact mount 240. The contact mounts 210 and 230 are arranged at the flange section 111 and the contact mounts 220 and 240 are arranged at the flange section 112. The flange sections 111 and 112 each have a groove 1114 and 1124 for leading through the wires 10 and 20. The wire 10 proceeding from the contact mount 210 can be led through the groove 1114 of the flange section in and be wound around the wire winding section 113 from the side of the flange section 111 in the direction of the flange section 112. The wire 10 can then be led through the groove 1124 of the flange section 112 to the contact mount 220 and be fixed thereto. The wire 20 proceeding from the contact mount 230 can be led through the groove 1114 of the flange section 111 and be wound around the wire winding section 113. The winding runs from the flange section 111 in the direction of the flange section 112. The wire 20 can then be led through the groove 1124 of the flange section 112 to the contact mount 240 and be fixed thereto.

The wires 10 and 20 are guided in a twisted fashion parallel to one another and are arranged jointly and thus simultaneously on the wire winding section during the winding of the wire winding section 113. Both wires have virtually the same length between the respective contact mounts of their ends. The wires 10 and 20 are arranged as a twisted wire pair on the wire winding section 113 in order to improve the impedance characteristic of the inductive component.

Figure 2A:
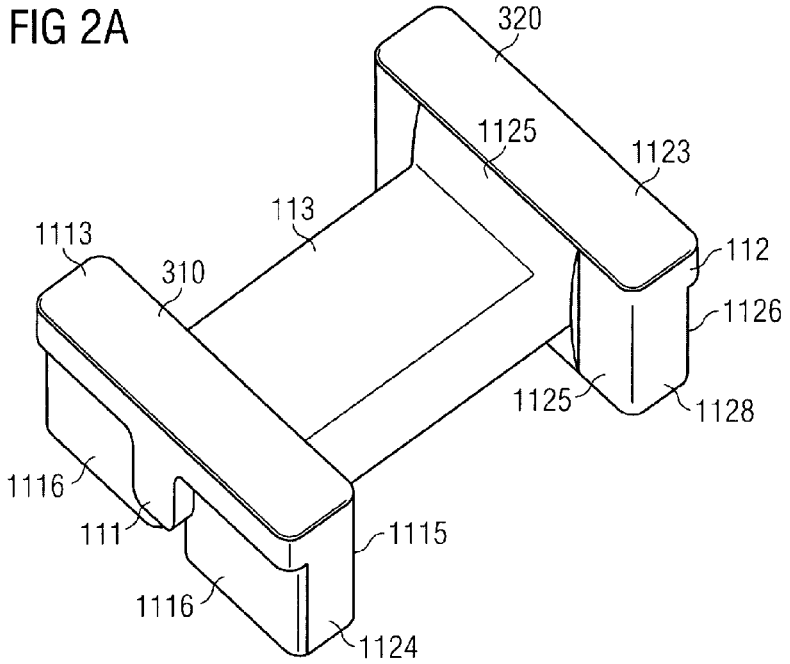
FIG. 2A shows a view of one embodiment of a first core part of an inductive component.
Figure 2B:
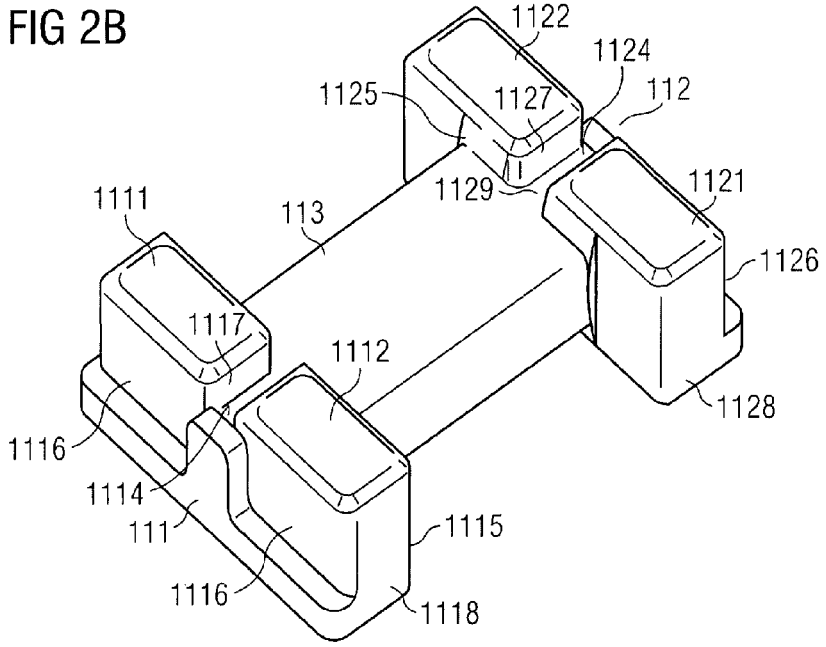
FIG. 2B shows a further view of the embodiment of the first core part of the inductive component.

FIGS. 2A and 2B show different views of the core part 110 of the inductive component 1 from FIGS. 1A and 1B. The core part 110 has the flange sections 111 and 112, which are arranged at different sides of the wire winding section 113. The flange sections 111, 112 project beyond the wire winding section 113 transversely with respect to the longitudinal direction of the wire winding section in all directions. The flange sections 111 and 112 are arranged symmetrically with respect to a longitudinal axis of the wire winding section.

The flange section 111 has a surface 1111, a surface 1112 and a surface 1113. The two surfaces 1111 and 1112 of the flange section 111 are arranged opposite relative to the surface 1113 of the flange section 111. The groove 1114 separates the surfaces 1111 and 1112 from one another. The groove 1114 is arranged in the center of the flange section 111 and opens centrally on the wire winding section 113. The flange section 111 thus has two limbs spaced apart from one another via the groove 1114.

The flange section 112 has a surface 1121, a surface 1122 and a surface 1123. The two surfaces 1121 and 1122 of the flange section 112 are arranged opposite relative to the surface 1123 of the flange section 112. The groove 1124 separates the surfaces 1121 and 1122 of the flange section 112 from one another. The groove 1124 is arranged in the center of the flange section 112 and opens centrally on the wire winding section 113. The flange section 112 thus has two limbs spaced apart from one another by the groove 1124.

The flange section 111 has an inner side wall 1115 arranged between the surfaces 1111, 1112 of the flange section 111 and the surface 1113 of the flange section 111 and facing the wire winding section 113. The flange section 111 furthermore has an outer side wall 1116 arranged between one of the surfaces 1111, 1112 and the surface 1113 of the flange section 111 and arranged opposite relative to the inner side wall 1115 of the flange section 111. The flange section 111 furthermore has an inner side wall 1117 arranged between one of the surfaces 1111, 1112 of the flange section 111 and a bottom surface 1119 of the groove 1114 of the flange section 111. The flange section 111 furthermore has an outer side wall 1118 arranged between one of the surfaces 1111, 1112 of the flange section 111 and the surface 1113 of the flange section 111 and arranged opposite relative to the inner side wall 1117 of the flange section 111.

The flange section 112 has an inner side wall 1125 arranged between one of the surfaces 1121, 1122 of the flange section 112 and the surface 1123 of the flange section 112 and facing the wire winding section 113. The flange section 112 furthermore has an outer side wall 1126 arranged between one of the surfaces 1121, 1122 of the flange section 112 and the surface 1123 of the flange section 112 and arranged opposite relative to the inner side wall 1125 of the flange section 112. Furthermore, the flange section 112 has an inner side wall 1127 arranged between one of the surfaces 1121, 1122 of the flange section 112 and a bottom surface 1129 of the groove 1124 of the flange section 112. Furthermore, the flange section 112 has an outer side wall 1128 arranged between one of the surfaces 1121, 1122 of the flange section 112 and the surface 1123 of the flange section 112 and arranged opposite relative to the inner side wall 1127 of the flange section 112.

In the case of the embodiment of the core part 110 as shown in FIGS. 2A and 2B, the respective inner side walls 1117 and 1127 of the flange sections 111 and 112 are arranged at right angles relative to the respective outer side wall 1116, 1126 and the respective inner side wall 1115, 1125 of the flange sections 111 and 112. The edges of the wire winding section 113 can be rounded along the length of the wire winding section 113 in order to avoid damage to the wires 10 and 20 during the winding of the wire winding section 113. Furthermore, the edge transitions between the wire winding section 113 and the flange sections 111 and 112 can likewise be rounded with a small radius, whereby the mechanical stability of the core can be increased. The material of the core is chosen in such a way that the inductive component has a high inductance for common-mode signals and a low DC resistance.

Figure 3:
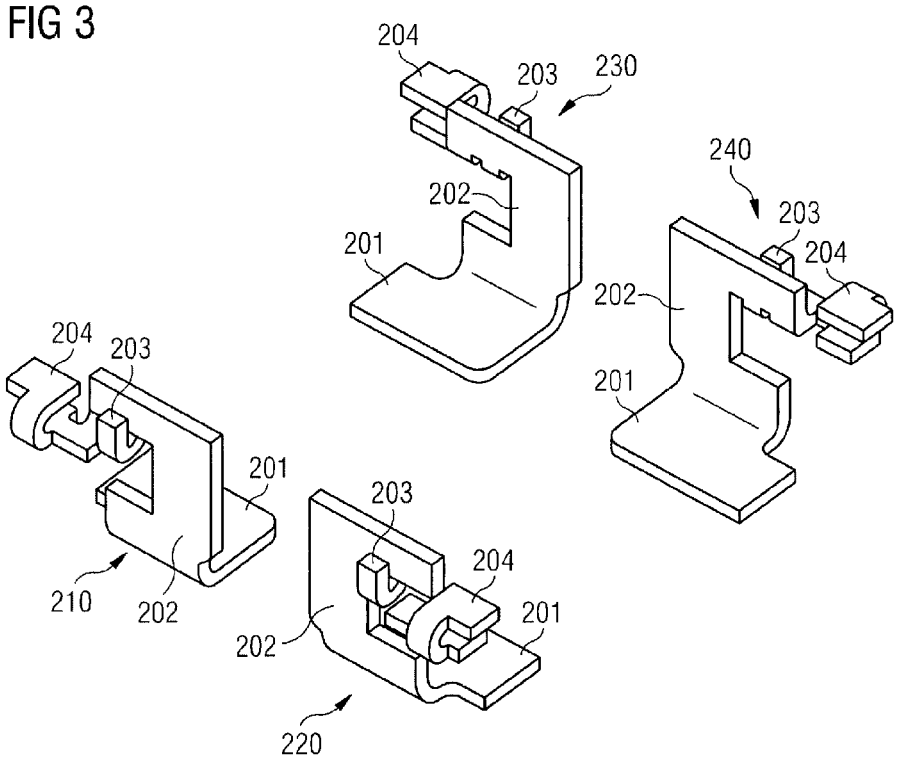
FIG. 3 shows one embodiment of contact mounts for contacting wires of the inductive component.

FIG. 3 shows a respective embodiment of the contact mounts 210, 220, 230 and 240 for fixing the ends of the wires 10 and 20. Each of the contact mounts 210, . . . , 240 has a base part 201 and a side part 202. Furthermore, each of the contact mounts 210, . . . , 240 has a guide element 203 for guiding the wires 10 and 20 and a contacting element 204 for contacting the wires 10 and 20. The guide element 203 and the contacting element 204 are arranged on the respective side part 202 of the contact mounts. The respective guide element 203 of the contact mounts can be fitted as a hooked projection to the respective side part 202 of the contact mounts. The respective contacting element 204 can have a semi-circularly curved section at which respectively flat material sections are arranged. Such a contacting element is suitable in particular for fixing the wire ends by means of soldering or welding, in particular by means of laser-pulsed welding.

Figure 4:
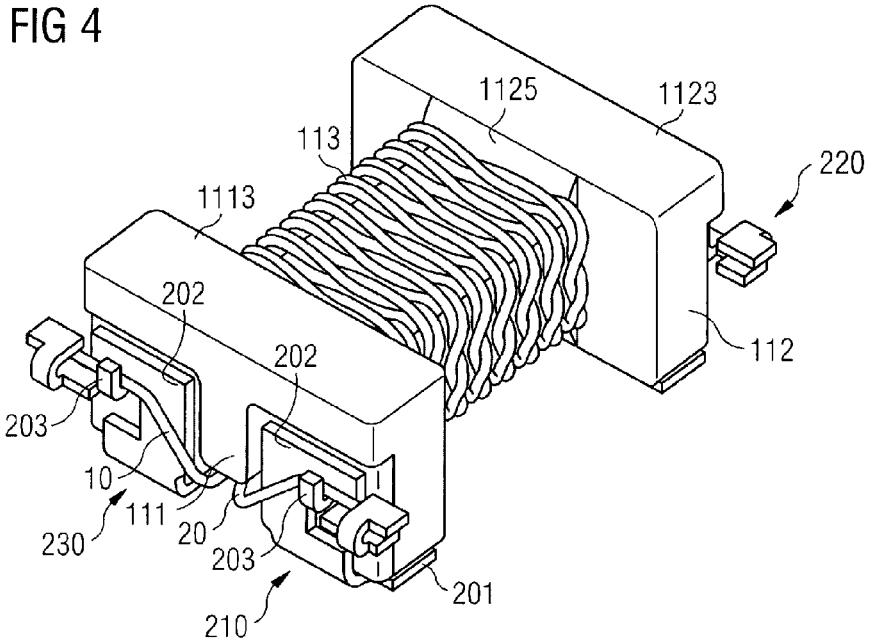
FIG. 4 shows one embodiment of a wound first core part of the inductive component with contact mounts.

FIG. 4 shows the core part 110 having the flange sections 111 and 112 and the wire winding section 113 arranged therebetween. The contact mounts 210 and 230 are arranged on the flange section 111, while the contact mounts 220 and 240 are arranged on the flange section 112. The respective base part 201 of the contact mounts 210 and 230 can be adhesively bonded on one of the surfaces 1111 and 1112 of the flange section 111. The respective side part 202 of the contact mounts 210 and 230 can be adhesively bonded onto the outer side wall 1116 of the flange section 111. The contact mounts 220 and 240 can be fixed to the flange section 112 in the same way. The respective base part 201 of the contact mounts 220 and 240 is adhesively bonded on one of the surfaces 1121, 1122 of the flange section 112. The respective side part 202 of the contact mounts 220 and 240 is adhesively bonded onto the outer side wall 1126 of the flange section 112.

As is further shown in FIG. 4, the insulation is stripped from the ends of the wires 10 and 20 and they are welded with contacting elements 204 of the contact mounts. The wires 10 and 20 proceeding from the respective contact mounts 210 and 230 are guided by the guide elements 203 of the respective contact mounts and through the groove 1114 of the flange section in to the wire winding section 113. The wire winding section is wound with the spatially jointly guided wires 10 and 20. The wires are guided at the flange section 112 through the groove 1124 and the ends of the wires 10, 20 are fixed to the corresponding contact mounts 220 and 240.

Figure 5A:
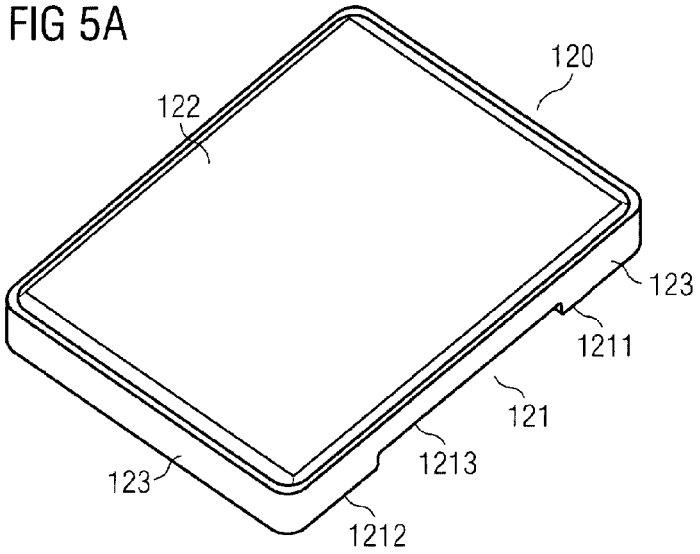
FIG. 5A shows a view of a first embodiment of a second core part of the inductive component.
Figure 5B:
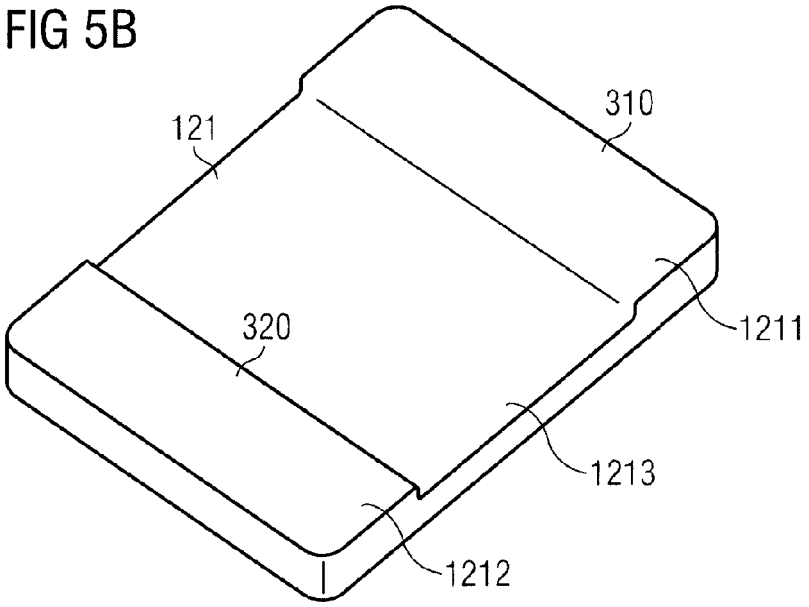
FIG. 5B shows a further view of the first embodiment of the second core part of the inductive component.

FIGS. 5A and 5B show one embodiment of the core part 120, which can be embodied as a plate core. FIG. 5A shows the top side of the core part 120 and FIG. 5B shows the associated underside of the core part 120. The core part 120 embodied as a plate core has a surface 121 having a lateral region 1211, a lateral region 1212 and a central region 1213 arranged therebetween. The surface 121 is situated opposite a surface 122 of the core part 120. Furthermore, the core part 120 has at least one side wall 123 arranged between the surface 121 and the surface 122. In the case of the embodiment of the core part 120 as shown in FIGS. 5A and 5B, the lateral regions 1211 and 1212 of the surface 121 of the core part 120 are embodied in an elevated fashion in comparison with the central region 1213 of the surface 121 of the core part 120.

Figure 5C:
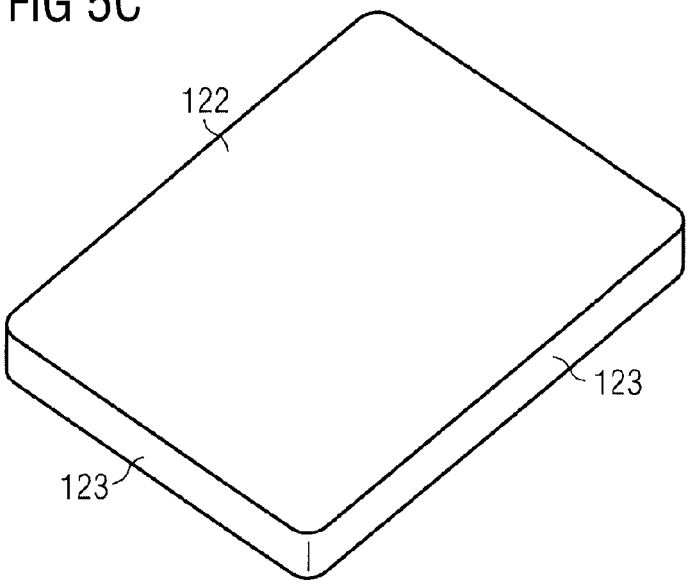
FIG. 5C shows a second embodiment of the second core part of the inductive component.

FIG. 5C shows a further embodiment of the core part 120 having the surface 122 situated opposite the surface 121 and having the side wall 123 of the core part 120 that lies between the surfaces 121 and 122. In contrast to the embodiment of the core part 120 as shown in FIGS. 5A and 5B, both the surface 121 and the surface 122 are embodied as a planar surface.

In order to close the magnetic circuit in the case of the inductive component, the core part 120, as shown in FIGS. 1A and 1B, is arranged on the flange sections 111 and 112. As is evident from FIGS. 1A and 1B, the core part 120 is arranged on the respective surfaces 1113 and 1123 of the flange sections 111 and 112. The core part 120 can be adhesively bonded onto the flange sections 111 and 112, for example. For this purpose, the lateral region 1211 of the surface 121 is adhesively bonded onto the surface 1113 of the flange section 111. The lateral region 1212 of the surface 121 of the core part 120 is adhesively bonded onto the surface 1123 of the flange section 112.

In accordance with one possible embodiment, an adhesive layer 310 can be arranged between the surface 1113 of the flange section 111 and the lateral region 1211 of the surface 121 of the core part 120. A further adhesive layer 320 can be arranged between the surface 1123 of the flange section 112 and the lateral region 1212 of the surface 121 of the core part 120. The adhesive layer 310 and the adhesive layer 320 can be applied to the lateral regions 1211 and 1212 of the surface 121 of the core part 120 and/or to the surfaces 1113, 1123 of the flange sections 111, 112 in such a way that a gap S having a gap width of less than 25 μm is formed between the core part 110 and the core part 120 when the core parts 110 and 120 are adhesively bonded together.

In accordance with a further possible embodiment, the adhesive bonding of the core part 110 with the core part 120 can be carried out by an adhesive layer 310 being arranged above a gap S between the side wall 123 of the core part 120 and one of the outer side walls 1116 and 1118 of the flange section 111. A further adhesive layer 320 can be arranged above a gap S between the side wall 123 of the core part 120 and one of the outer side walls 1126, 1128 of the flange section 112. In this embodiment, the adhesive layers 310 and 320 are not applied between the respective contact areas of the core parts 110 and 120, but rather are applied laterally at the two core parts. As a result, the gap width between the core parts 110 and 120 can be reduced to a gap width that is less than 10 μm.

In accordance with one advantageous embodiment, the surface 1113 of the flange section 111 and/or the lateral region 1211 of the surface 121 of the core part 120 can be ground. Likewise, the surface 1123 of the flange section 112 and/or the lateral region 1212 of the surface 121 of the core part 120 can be ground. By way of example, mirror grinding or so-called lapping can be used for grinding the surfaces. As a result, even with relatively coarse granulation, very high surface qualities can be achieved owing to the small material removal. On account of the abovementioned types of grinding, the surfaces 1113 and 1123 and the lateral regions 1211 and 1212 of the surface 121 are very smooth, such that the gap width between the core parts 110 and 120 can be reduced again as a result when the core parts 110 and 120 are joined together.

On account of the large and planar contact area and the small gap width associated therewith between the core part 110 and the core part 120, large inductance values can be achieved with the inductive component.

Figure 6:
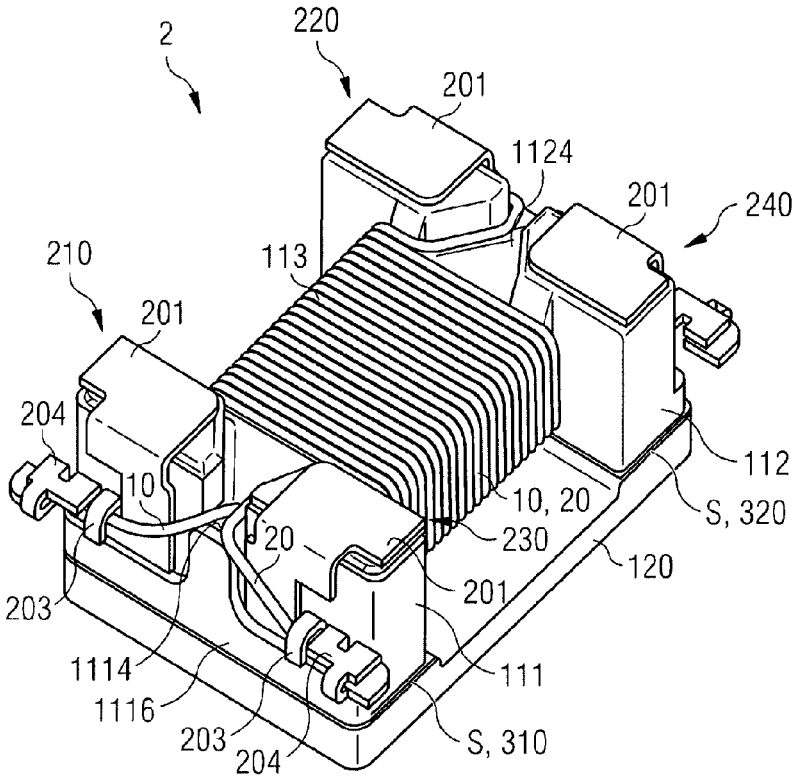
FIG. 6 shows a view of a second embodiment of an inductive component.

FIG. 6 shows a second embodiment 2 of the inductive component. The inductive component comprises a core 100 having a core part 110 and a core part 120. The core part 110 has the flange sections 111 and 112 and the wire winding section 113 for winding with the wires 10 and 20. In a manner similar to that in the case of the embodiment 1 of the inductive component, each of the flange sections 111 and 112 has a groove 1114 and 1124, respectively, for leading through the wires 10 and 20. The contact mounts 210, 220, 230 and 240 already known from the embodiment 1 of the inductive component are provided for contacting the ends of the wires 10 and 20.

In the case of the embodiment 2 of the inductive component, the core part 120 can have one of the embodiments shown in FIGS. 5A, 5B and 5C, wherein in FIG. 6 the inductive component 2 comprises the core part 120 in accordance with the configurational form shown in FIGS. 5A and B. The lateral region 1211 of the surface 121 of the core part 120 can be adhesively bonded on the surface 1113 of the flange section 111. The lateral region 1212 of the surface 121 of the core part 120 can be adhesively bonded on the surface 1123 of the flange section 112. The lateral regions of the surface 121 and/or the surfaces 1113, 1123 of the flange sections 111, 112 can be ground smooth before the two core parts are connected, for example by mirror grinding or lapping as already mentioned above.

In a manner similar to that in the case of the embodiment shown in FIGS. 1A and 1B, an adhesive layer can be arranged between the contact areas of the flange sections 111 and 112 and the core part 120. As an alternative thereto, the adhesive layer can also be arranged laterally at the flange section 111 and the core part 120 and also laterally at the flange section 112 and the core part 120.

Only the differences in the embodiment 2 in comparison with the embodiment 1 of the inductive component are discussed below. In this case, besides FIG. 6, reference is also made to FIG. 7, which shows the inductive component 2 shown in FIG. 6 two-dimensionally in a plan view.

The wires 10 and 20 can be guided through the groove 1114 of the flange section 111 from the contact mounts 210 and 230 onto the wire winding section 113. After the wires have been wound around the wire winding section 113, the wires 10, 20 are guided through the groove 1124 of the flange section 112 and fixed to the contact mounts 220, 240. In contrast to the embodiment of the inductive component 1 as shown in FIGS. 1A and 1B or the embodiment of the core part 110 of the inductive component 1 as shown in FIG. 2B, in the case of the embodiment 2 of the inductive component as shown in FIGS. 6 and 7, the respective inner side surfaces 1117, 1127 of the flange sections 111, 112 of the core part 110 are not arranged at right angles relative to the inner side wall 1115 and the outer side wall 1116 of the flange section 111 nor at right angles to the inner side wall 1125 and the outer side wall 1126 of the flange section 112.

FIG. 8 shows, for better illustration, the core part 110 of the embodiment of the inductive component 2 as shown in FIGS. 6 and 7 without the wire winding. The respective inner side wall 1117, 1127 of the flange sections 111, 112 has a section A1 and a section A2. The respective section A1 of the inner side walls 1117, 1127 of the flange sections 111, 112 is arranged at right angles relative to the respective outer side wall 1116, 1126 of the flange sections 111, 112. The respective section A2 of the inner side walls 1117, 1127 of the flange sections 111, 112 is arranged obliquely, for example at an angle of between 120° and 160°, relative to the respective section A1 of the inner side walls 1117, 1127 and relative to the respective inner side wall 1115, 1125 of the flange sections 111, 112. In contrast to the embodiment of the core part 110 as shown in FIGS. 1A, 1B and 2B, this type of embodiment of the core part 110 allows a very fast winding of the wire winding section 113 with the wires 10 and 20 and increases the symmetry of the inductive component in the region of the grooves 1114 and 1124.

Figure 9:
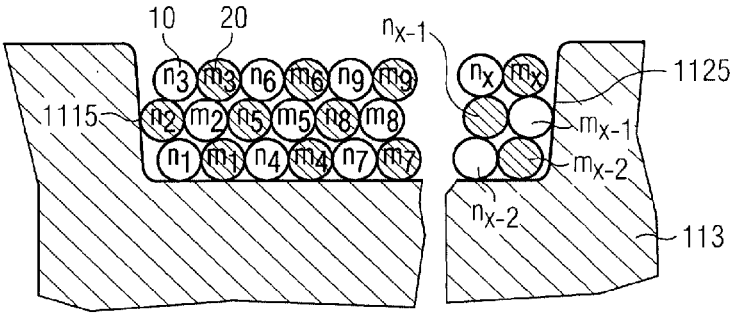
FIG. 9 shows a first embodiment of a winding pattern for winding a core of an inductive component.
Figure 10:
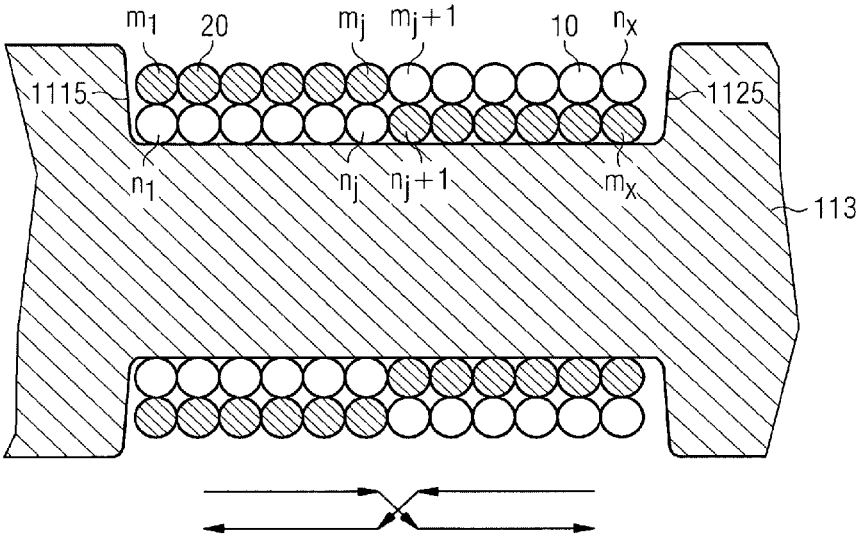
FIG. 10 shows a second embodiment of a winding pattern for winding a core of an inductive component.

FIGS. 9 and 10 show different types of winding with which the wires 10 and 20 can be wound onto the wire winding section 113 of the core part 110. The wires 10 and 20 are arranged jointly, simultaneously in FIG. 9, on the wire winding section 113. Both wires 10 and 20 have the same length between the respective contact mounts to which their ends are fixed.

In the case of the embodiment shown in FIG. 9, a multiplicity of turns $n_1, \ldots, n_x$ of the wires 10 and turns $m_1, \ldots, m_x$ of the wires 20 are applied in a twisted fashion on the wire winding section 113. Such an embodiment is shown for example in FIGS. 1A and 1B. Each of the turns $n_1, \ldots n_x$ and $m_1, \ldots, m_x$ is wound once around the wire winding section 113. In each of the turns, the wires 10 and 20 are arranged alongside one another and one above another in the longitudinal direction of the wire winding section 113. In each of the turns, the wires 10 and 20 are arranged in a manner twisted among one another.

In this case, the wires 10 and 20 are wound onto the wire winding section 113 in such a way that after guiding the wires 10 and 20 through the groove 1114 of the flange section 111, a first turn $n_1$, $m_1$ of the wires 10, 20 is arranged directly on the wire winding section 113 alongside the respective inner side wall 1115 of the flange section 111. Subsequently to the turn $n_1$, $m_1$, at least one further turn $n_2$, $m_2$, $n_3$, $m_3$ is arranged on the first turn $n_1$, $m_1$. Consequently, the inductive component comprises a multiplicity of winding sections having turns arranged one above another. After a first winding section has been wound from the turns $n_1$, $m_1$, $n_2$, $m_2$ and $n_3$, $m_3$, a further turn $n_4$, $m_4$ is arranged directly onto the wire winding section 113 alongside the first turn $n_1$, $m_1$, further turns $n_5$, $m_5$ and $n_6$, $m_6$ again being arranged above said further turn. A second winding section comprises for example the turns $n_4$, $m_4$, $n_5$, $m_5$ and $n_6$, $m_6$. In this way, between the inner side wall 1115 of the flange section 111 and the inner side wall 1125 of the flange section 112, the winding space is filled with a multiplicity of winding sections each comprising turns arranged one above another.

By virtue of the use of the twisted wires 10 and 20 and the position of the wires 10 and 20 in the various turns, as shown in FIG. 9, and the multiplicity of winding sections having twisted wires arranged one above another, the inductive component has a low and symmetrical capacitive coupling of the wires among one another and also a low mode conversion and a low leakage inductance. The wires 10 and 20 can already be twisted among one another before application to the wire winding section 113 or can be twisted only with the wrapping of the wire winding section. The number of turns depends on the desired inductance of the component. If the inductive component is intended to have an inductance of 350 mH, for example, in total approximately 50 turns are necessary for this purpose.

FIG. 10 shows a further winding method and a further possible arrangement of the wires 10 and 20 on the wire winding section 113 of the core part 110. In this embodiment, too, a multiplicity of turns $n_i$, $m_i$ where i=1, . . . , x of the wires 10 and 20 are arranged on the wire winding section 113. Each of the turns $n_i$, $m_i$ is wound once around the wire winding section 113. In each of the turns $n_i$, $m_i$, the wires 10 and 20 are arranged one above another perpendicular to the longitudinal direction of the wire winding section 113. In contrast to the embodiment shown in FIG. 9, however, the wires are arranged in an untwisted manner.

The wires 10 and 20 are wound on the wire winding section 113 in such a way that after guiding the wires 10 and 20 through the groove 1114 of the flange section 111, a first winding part comprising the turns $n_1$, $m_2$, . . . , $n_j$, $m_j$ of the wires 10, 20 and a second winding part comprising the turns $n_{j+i}$, $m_{j+1}$, . . . , $n_x$, $m_x$, are arranged on the wire winding section 113. The turns $n_1$, $m_2$, . . . , $n_j$, $m_j$ are arranged directly alongside one another on the wire winding section 113 alongside the first inner side wall 1115 of the flange section 111. In each turn of the first winding part, the wires 10 and 20 are arranged in the same position relative to one another. Subsequently to the first winding part, the second winding part is arranged directly onto the wire winding section 113 between the first winding part and the inner side wall 1125 of the flange section 112. In each turn of the second winding part $n_{j+i}$, $m_{j+1}$, . . . , $n_x$, $m_x$, the wires 10 and 20 are arranged in the same position relative to one another. However, the position of the wires 10 and 20 in the first winding part is different than the position of the wires 10 and 20 in the second winding part. The crossover of the positions of the wires takes place at half of the length of the wire winding section 113. By virtue of the type of winding shown in FIG. 10, the inductive component has a low mode conversion, a symmetrical capacitive overcoupling between the wires 10 and 20 and also a low leakage inductance.

The wires 10 and 20 can be wound onto the wire winding section 113 in a manner arranged one above another proceeding from one of the side walls 1115, 1125 as far as the other of the side walls, wherein the vertical position of the wires in the individual turns is transposed in the center of the wire winding section. In accordance with a different winding method, the wires 10 proceeding from the side wall 1115 in the direction of the side wall 1125 and the wires 20 proceeding from the side wall 1125 in the direction of the side wall 1115 can be wound around the wire winding section 113, wherein in the center of the wire winding section 113 the wires 10 are wound over the wires 20 as far as the side wall 1125 and the wires 20 are wound over the wires 10 as far as the side wall 1115.

The twisted type of winding of the wires 10 and 20 as shown in FIG. 9 and the crossed type of winding of the wires 10 and 20 as shown in FIG. 10 can be applied in each of the embodiments 1 and 2.

The invention claimed is:

1. An inductive component comprising:

a first wire;

a second wire;

a core having a first core part and a second core part, wherein the first core part has a first flange section, a second flange section and a wire winding section for winding the first and second wires; and a plurality of contact mounts for contacting a respective end of the first and second wires, wherein each of the first and second flange sections has a first inner side wall arranged between a respective one of first and second surfaces of the first and second flange sections and a respective third surface of the first and second flange sections, each first inner side wall facing a wire winding section, wherein each of the first and second flange sections has a first outer side wall arranged between a respective one of the first and second surfaces of the first and second flange sections and the respective third surface of the first and second flange sections, a respective first outer side wall arranged opposite to a respective first inner side wall of the first and second flange sections, wherein each of the first and second flange sections has a second inner side wall arranged between the respective one of the first and second surfaces of the first and second flange sections and a bottom surface of a respective single groove of the first and second flange sections, and wherein a respective second inner side wall of the first and second flange sections is arranged obliquely, at an angle of between 120° and 160°, relative to the respective first inner side wall of the first and second flange sections.

2. The inductive component according to claim 1, wherein the respective second inner side wall of the first and second flange sections has a first section and a second section, wherein the respective first section of the second inner side wall of the first and second flange sections is arranged at a right angle relative to the respective first outer side wall of the first and second flange sections, and wherein the respective second section of the second inner side wall of the first and second flange sections is arranged obliquely, at an angle of between 120° and 160°, relative to the respective first section of the second inner side wall and relative to a respective first inner side surface of the first and second flange sections.

3. The inductive component according to claim 1, wherein the first and second flange sections project beyond the wire winding section transversely with respect to a longitudinal direction of the wire winding section, wherein the first and second flange sections are arranged symmetrically with respect to the longitudinal direction of the wire winding section, wherein the first flange section has a second outer side wall arranged between one of the first and second surfaces of the first flange section and the third surface of the first flange section, the second outer side wall of the first flange section being arranged opposite to the second inner side wall of the first flange section, and wherein the second flange section has a second outer side wall arranged between one of the first and second surfaces of the second flange section and the third surface of the second flange section, the second outer side wall being arranged opposite to the second inner side wall of the second flange section.

4. The inductive component according to claim 3, wherein the second core part comprises a plate comprising:

a first surface;

a first lateral region;

a second lateral region;

a central region arranged between the first and second lateral regions;

a second surface situated opposite to the first surface; and at least one side wall arranged between the first and second surfaces.

5. The inductive component according to claim 4, wherein an adhesive layer is arranged between the third surface of the first flange section and the first lateral region of the first surface of the second core part, wherein the adhesive layer provides a gap of between 1 μm and 25 μm between the third surface of the first flange section and the first lateral region of the first surface of the second core part, wherein a further adhesive layer is arranged between the third surface of the second flange section and the second lateral region of the first surface of the second core part, and wherein the further adhesive layer provides a gap of between 1 μm and 25 μm between the third surface of the second flange section and the second lateral region of the first surface of the second core part.

6. The inductive component according to claim 4, wherein an adhesive layer is arranged above a gap between the at least one side wall of the plate and at least one of the first and second outer side walls of the first flange section, wherein a further adhesive layer is arranged above a gap between the at least one side wall of the plate and at least one of the first and second outer side walls of the second flange section, and wherein a gap width of each gap is less than 10 μm.

7. The inductive component according to claim 4, wherein the third surface of the first flange section and/or the first lateral region of the first surface of the second core part are/is defined as ground, and wherein the third surface of the second flange section and/or the second lateral region of the first surface of the second core part are/is defined as ground.

* * * * *